US010241448B2

(12) United States Patent
Sawada et al.

(10) Patent No.: US 10,241,448 B2
(45) Date of Patent: Mar. 26, 2019

(54) FIXING DEVICE AND IMAGE FORMING APPARATUS HAVING NIP PAD INCLUDING A CENTER BEND LINE

(71) Applicants: Kazunari Sawada, Shizuoka (JP); Ippei Fujimoto, Kanagawa (JP); Kenji Ishii, Kanagawa (JP); Takashi Seto, Kanagawa (JP); Hiroshi Yoshinaga, Chiba (JP); Takayuki Seki, Kanagawa (JP)

(72) Inventors: Kazunari Sawada, Shizuoka (JP); Ippei Fujimoto, Kanagawa (JP); Kenji Ishii, Kanagawa (JP); Takashi Seto, Kanagawa (JP); Hiroshi Yoshinaga, Chiba (JP); Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/627,704

(22) Filed: Jun. 20, 2017

(65) Prior Publication Data

US 2018/0017910 A1 Jan. 18, 2018

(30) Foreign Application Priority Data

Jul. 15, 2016 (JP) ..... 2016-140758

(51) Int. Cl.
*G03G 15/20* (2006.01)

(52) U.S. Cl.
CPC ..... *G03G 15/2025* (2013.01); *G03G 15/2032* (2013.01); *G03G 15/2053* (2013.01);
(Continued)

(58) Field of Classification Search
CPC ..... G03G 15/2075; G03G 15/2035; G03G 15/2025; G03G 2215/2035
See application file for complete search history.

(56) References Cited

U.S. PATENT DOCUMENTS 7,986,909 B2 * 7/2011 Nanba ..... G03G 15/2025 399/329
2004/0151522 A1 * 8/2004 Kato ..... G03G 15/2025 399/328

(Continued)

FOREIGN PATENT DOCUMENTS

JP 2005-242113 9/2005
JP 2008-146964 6/2008

OTHER PUBLICATIONS

U.S. Appl. No. 15/440,179, filed Feb. 23, 2017.
U.S. Appl. No. 15/375,757, filed Dec. 12, 2016.
U.S. Appl. No. 15/447,709, filed Mar. 2, 2017.

*Primary Examiner* — Walter L Lindsay, Jr.
*Assistant Examiner* — Arlene Heredia
(74) *Attorney, Agent, or Firm* — Oblon, McClelland, Maier & Neustadt, L.L.P.

(57) ABSTRACT

A fixing device includes a nip former including a first face to form a fixing nip, a second face being disposed upstream from the first face in a rotation direction of a rotator and defining a predetermined angle relative to the first face, and a bent portion coupling the first face to the second face. An inner circumferential surface of the rotator slides over the first face. A lateral end accumulation portion and a center accumulation portion are defined by the second face and the bent portion of the nip former and the inner circumferential surface of the rotator. The lateral end accumulation portion is accumulated with a lubricant in a first amount. The center accumulation portion is disposed inboard from the lateral end accumulation portion in an axial direction of the rotator and accumulated with the lubricant in a second amount greater than the first amount.

17 Claims, 8 Drawing Sheets

(52) U.S. Cl.
CPC ..... *G03G 2215/025* (2013.01); *G03G 2215/2035* (2013.01)

(56) References Cited

U.S. PATENT DOCUMENTS

| | | | | |
|---|---|---|---|---|
| 2014/0241769 | A1* | 8/2014 | Tanto | G03G 15/2025 399/329 |
| 2014/0369726 | A1* | 12/2014 | Soeda | G03G 15/2053 399/329 |
| 2015/0093167 | A1* | 4/2015 | Hazeyama | G03G 15/2053 399/329 |
| 2015/0277314 | A1* | 10/2015 | Hazeyama | G03G 15/2053 399/329 |
| 2016/0161890 | A1 | 6/2016 | Shoji et al. | |
| 2016/0223961 | A1 | 8/2016 | Takagi et al. | |
| 2016/0274511 | A1 | 9/2016 | Ogino et al. | |
| 2016/0274514 | A1 | 9/2016 | Ishii et al. | |
| 2016/0334742 | A1 | 11/2016 | Kobashigawa et al. | |
| 2016/0378027 | A1 | 12/2016 | Sawada et al. | |
| 2017/0176907 | A1* | 6/2017 | Sawada | G03G 15/2085 |

* cited by examiner

FIXING DEVICE AND IMAGE FORMING APPARATUS HAVING NIP PAD INCLUDING A CENTER BEND LINE

CROSS-REFERENCE TO RELATED APPLICATION

This patent application is based on and claims priority pursuant to 35 U.S.C. § 119 to Japanese Patent Application No. 2016-140758, filed on Jul. 15, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a rotator, such as a fixing roller, a fixing belt (e g, an endless belt), and a fixing film, heated by a heater and an abutment, such as a pressure roller and a pressure belt, pressed against the rotator to form a fixing nip therebetween through which a recording medium bearing a toner image is conveyed. As the recording medium bearing the toner image is conveyed through the fixing nip, the rotator and the abutment apply heat and pressure to the recording medium, melting and fixing the toner image on the recording medium.

SUMMARY

This specification describes below an improved fixing device. In one exemplary embodiment, the fixing device includes a rotator rotatable in a rotation direction and an abutment contacting an outer circumferential surface of the rotator. A nip former disposed inside the rotator presses against the abutment via the rotator to form a fixing nip between the rotator and the abutment. The nip former bears a lubricant interposed between the nip former and an inner circumferential surface of the rotator. The nip former includes a first face to form the fixing nip. The inner circumferential surface of the rotator slides over the first face. A second face is disposed upstream from the first face in the rotation direction of the rotator and defines a predetermined angle relative to the first face. A bent portion couples the first face to the second face. A lateral end accumulation portion is defined by the second face and the bent portion of the nip former and the inner circumferential surface of the rotator and accumulated with the lubricant in a first amount. A center accumulation portion is defined by the second face and the bent portion of the nip former and the inner circumferential surface of the rotator and disposed inboard from the lateral end accumulation portion in an axial direction of the rotator. The center accumulation portion is accumulated with the lubricant in a second amount greater than the first amount.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a rotator rotatable in a rotation direction and an abutment contacting an outer circumferential surface of the rotator. A nip former disposed inside the rotator presses against the abutment via the rotator to form a fixing nip between the rotator and the abutment. The nip former bears a lubricant interposed between the nip former and an inner circumferential surface of the rotator. The nip former includes a first face to form the fixing nip. The inner circumferential surface of the rotator slides over the first face. A second face is disposed upstream from the first face in the rotation direction of the rotator and defines a predetermined angle relative to the first face. A bent portion couples the first face to the second face. A lateral end accumulation portion is defined by the second face and the bent portion of the nip former and the inner circumferential surface of the rotator and accumulated with the lubricant in a first amount. A center accumulation portion is defined by the second face and the bent portion of the nip former and the inner circumferential surface of the rotator and disposed inboard from the lateral end accumulation portion in an axial direction of the rotator. The center accumulation portion is accumulated with the lubricant in a second amount greater than the first amount.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
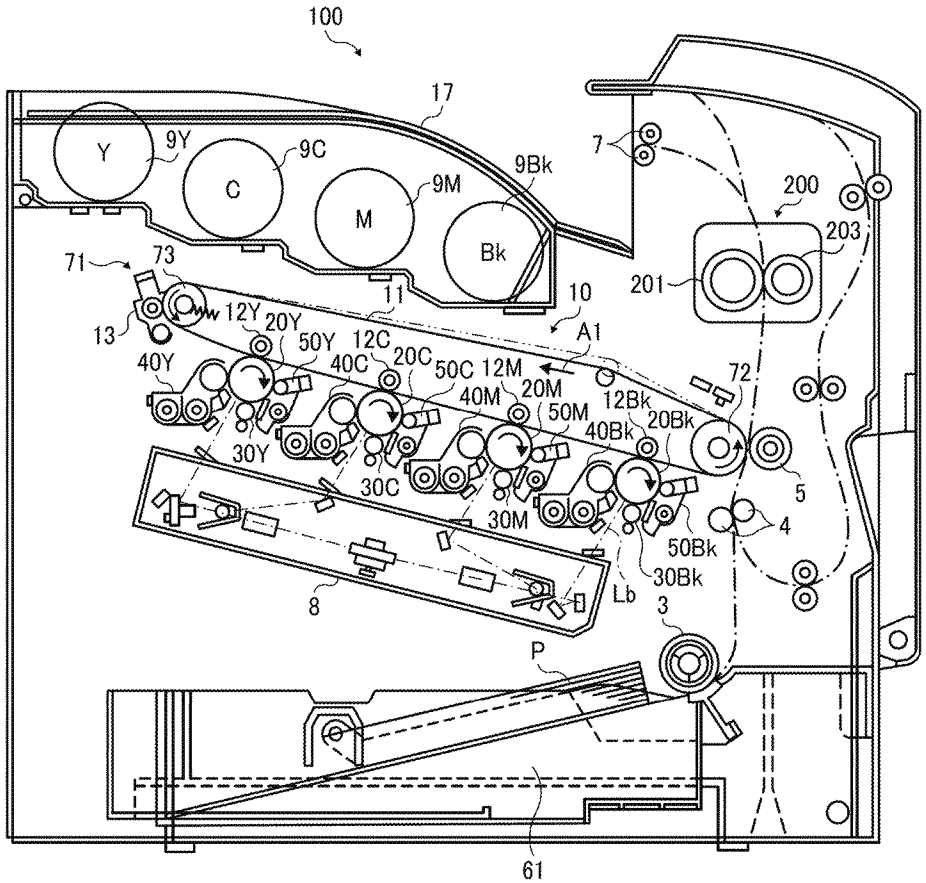
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an exemplary embodiment is explained.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms a color toner image on a recording medium by electrophotography. Alternatively, the image forming apparatus 100 may be a monochrome printer that forms a monochrome toner image on a recording medium.

Referring to FIG. 1, a description is provided of a construction of the image forming apparatus 100.

The image forming apparatus 100 is a color printer employing a tandem system in which a plurality of image forming devices for forming toner images in a plurality of colors, respectively, is aligned in a stretch direction of a transfer belt 11 serving as an intermediate transferor. Alternatively, the image forming apparatus 100 may employ other systems and may be a copier, a facsimile machine, a printer, a multifunction peripheral or a multifunction printer (MFP) having two or more of copying, printing, scanning, facsimile, and plotter functions, or the like.

The image forming apparatus 100 employs a tandem structure in which four photoconductive drums 20Y, 20C, 20M, and 20Bk serving as image bearers that bear yellow, cyan, magenta, and black toner images in separation colors, respectively, are aligned. The yellow, cyan, magenta, and black toner images formed on the photoconductive drums 20Y, 20C, 20M, and 20Bk, respectively, are primarily transferred successively onto the transfer belt 11 serving as an endless belt disposed opposite the photoconductive drums 20Y, 20C, 20M, and 20Bk as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a sheet P serving as a recording medium collectively in a secondary transfer process.

Each of the photoconductive drums 20Y, 20C, 20M, and 20Bk is surrounded by image forming components that form the yellow, cyan, magenta, and black toner images on the photoconductive drums 20Y, 20C, 20M, and 20Bk as the photoconductive drums 20Y, 20C, 20M, and 20Bk rotate clockwise in FIG. 1. Taking the photoconductive drum 20Bk that forms the black toner image, the following describes an image forming operation to form the black toner image. The photoconductive drum 20Bk is surrounded by a charger 30Bk, a developing device 40Bk, a primary transfer roller 12Bk, and a cleaner 50Bk in this order in a rotation direction of the photoconductive drum 20Bk. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in a rotation direction of the photoconductive drums 20Y, 20C, and 20M, respectively. After the charger 30Bk uniformly charges the photoconductive drum 20Bk, an optical writing device 8 writes an electrostatic latent image on the photoconductive drum 20Bk with a laser beam Lb.

As the transfer belt 11 rotates in the rotation direction A1, the yellow, cyan, magenta, and black toner images formed on the photoconductive drums 20Y, 20C, 20M, and 20Bk, respectively, are primarily transferred successively onto the transfer belt 11, thus being superimposed on the same position on the transfer belt 11. In the primary transfer process, the primary transfer rollers 12Y, 12C, 12M, and 12Bk disposed opposite the photoconductive drums 20Y, 20C, 20M, and 20Bk via the transfer belt 11, respectively, apply a voltage to the photoconductive drums 20Y, 20C, 20M, and 20Bk successively from the upstream photoconductive drum 20Y to the downstream photoconductive drum 20Bk in the rotation direction A1 of the transfer belt 11.

The photoconductive drums 20Y, 20C, 20M, and 20Bk are aligned in this order in the rotation direction A1 of the transfer belt 11. The photoconductive drums 20Y, 20C, 20M, and 20Bk are located in four image forming stations that form the yellow, cyan, magenta, and black toner images, respectively.

The image forming apparatus 100 includes the four image forming stations that form the yellow, cyan, magenta, and black toner images, respectively, a transfer belt unit 10, a secondary transfer roller 5, a transfer belt cleaner 13, and the optical writing device 8. The transfer belt unit 10 is situated above and disposed opposite the photoconductive drums 20Y, 20C, 20M, and 20Bk. The transfer belt unit 10 incorporates the transfer belt 11 and the primary transfer rollers 12Y, 12C, 12M, and 12Bk. The secondary transfer roller 5 is disposed opposite the transfer belt 11 and driven and rotated in accordance with rotation of the transfer belt 11. The transfer belt cleaner 13 is disposed opposite the transfer belt 11 to clean the transfer belt 11. The optical writing device 8 is situated below and disposed opposite the four image forming stations.

The optical writing device 8 includes a semiconductor laser serving as a light source that writes an electrostatic latent image, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20Bk thereto, forming electrostatic latent images on the photoconductive drums 20Y, 20C, 20M, and 20Bk, respectively. FIG. 1 illustrates the light beam Lb irradiating the photoconductive drum 20Bk. Similarly, light beams Lb irradiate the photoconductive drums 20Y, 20C, and 20M, respectively.

The image forming apparatus 100 further includes a sheet feeder 61 and a registration roller pair 4. The sheet feeder 61 incorporates a paper tray that loads a plurality of sheets P to be conveyed to a secondary transfer nip formed between the transfer belt 11 and the secondary transfer roller 5. The registration roller pair 4 conveys a sheet P conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor that detects a leading edge of the sheet P as the sheet P reaches the registration roller pair 4.

The image forming apparatus 100 further includes a fixing device 200, an output roller pair 7, an output tray 17, and toner bottles 9Y, 9C, 9M, and 9Bk. The fixing device 200, serving as a fusing unit employing a contact heating system to heat the sheet P, includes a fixing belt 201 and a pressure roller 203 that fix a color toner image formed by the yellow, cyan, magenta, and black toner images secondarily transferred from the transfer belt 11 onto the sheet P thereon. The output roller pair 7 ejects the sheet P bearing the fixed color toner image onto an outside of the image forming apparatus 100, that is, the output tray 17. The output tray 17 is disposed atop the image forming apparatus 100 and stacks the sheet P ejected by the output roller pair 7. The toner bottles 9Y, 9C, 9M, and 9Bk are situated below the output tray 17 and inside the image forming apparatus 100. The toner bottles 9Y, 9C, 9M, and 9Bk are replenished with fresh yellow, cyan, magenta, and black toners, respectively.

The transfer belt unit 10 includes a driving roller 72 and a driven roller 73 over which the transfer belt 11 is looped, in addition to the transfer belt 11 and the primary transfer rollers 12Y, 12C, 12M, and 12Bk. Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12Bk, the secondary transfer roller 5, and the transfer belt cleaner 13 construct a transfer device 71.

The sheet feeder 61 is situated in a lower portion of the image forming apparatus 100 and includes a feed roller 3 that contacts an upper side of an uppermost sheet P of the plurality of sheets P loaded on the paper tray of the sheet feeder 61. As the feed roller 3 is driven and rotated counterclockwise in FIG. 1, the feed roller 3 feeds the uppermost sheet P to the registration roller pair 4.

The transfer belt cleaner 13 of the transfer device 71 includes a cleaning brush and a cleaning blade being disposed opposite and contacting the transfer belt 11. The cleaning brush and the cleaning blade scrape a foreign substance such as residual toner particles off the transfer belt 11, removing the foreign substance from the transfer belt 11 and thereby cleaning the transfer belt 11. The transfer belt cleaner 13 further includes a waste toner conveyer that conveys the residual toner particles removed from the transfer belt 11.

Figure 2:
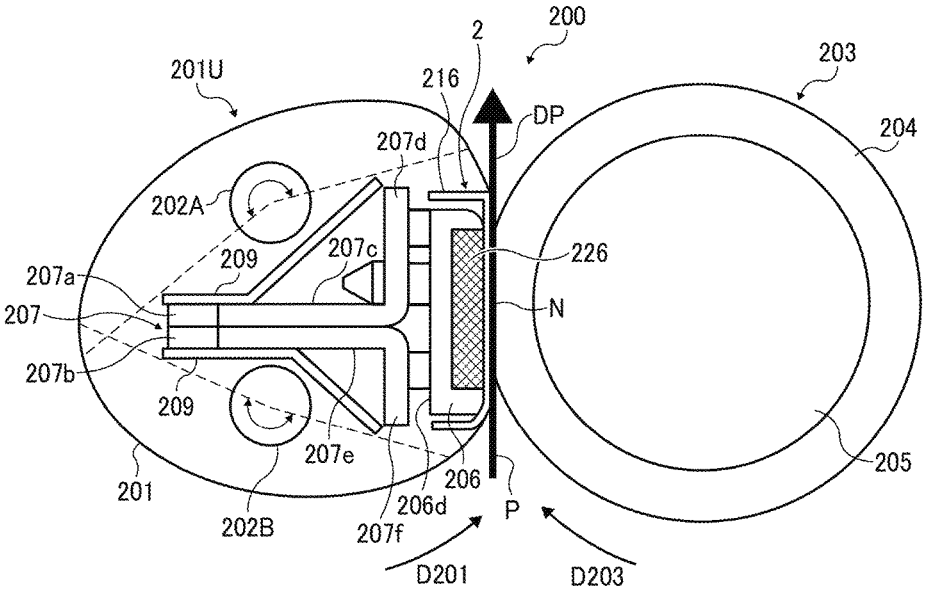
FIG. 2 is a schematic vertical cross-sectional view of a fixing device incorporated in the image forming apparatus depicted in FIG. 1.

Referring to FIG. 2, a description is provided of a construction of the fixing device 200 installed in the image forming apparatus 100 depicted in FIG. 1.

FIG. 2 is a schematic vertical cross-sectional view of the fixing device 200. As illustrated in FIG. 2, the fixing device 200 (e.g., a fuser or a fusing unit) includes the fixing belt 201 and the pressure roller 203. The fixing belt 201 serves as a rotator, an endless belt, a fixing rotator, or a fixing member that is formed into a loop and rotatable in a rotation direction D201. The pressure roller 203 serves as an abutment, a pressure rotator, or a pressure member that is disposed opposite the fixing belt 201 to come into contact with an outer circumferential surface of the fixing belt 201 and is rotatable in a rotation direction D203. Two halogen heaters, that is, a first halogen heater 202A and a second halogen heater 202B, serve as a plurality of heaters or a plurality of fixing heaters that heats the fixing belt 201 in a non-nip span other than a fixing nip N in the rotation direction D201 of the fixing belt 201. The first halogen heater 202A and the second halogen heater 203B heat the fixing belt 201 directly with light irradiating an inner circumferential surface of the fixing belt 201, thus heating the fixing belt 201 with radiation heat.

A nip formation pad 206 is disposed inside the loop formed by the fixing belt 201 and presses against the pressure roller 203 via the fixing belt 201 to form the fixing nip N between the fixing belt 201 and the pressure roller 203. As the fixing belt 201 rotates in the rotation direction D201, the inner circumferential surface of the fixing belt 201 slides over the nip formation pad 206 indirectly via a thermal conduction aid 216. As a sheet P bearing a toner image is conveyed through the fixing nip N in a sheet conveyance direction DP, the fixing belt 201 and the pressure roller 203 fix the toner image on the sheet P under heat and pressure.

As illustrated in FIG. 2, an opposed portion of the thermal conduction aid 216, which is disposed opposite the fixing belt 201, is planar. Alternatively, the opposed portion of the thermal conduction aid 216 may be contoured into a recess, a curve, or other shapes. If the thermal conduction aid 216 contours the fixing nip N into the recess, the recessed fixing nip N directs the leading edge of the sheet P toward the pressure roller 203 as the sheet P is ejected from the fixing nip N, facilitating separation of the sheet P from the fixing belt 201 and suppressing jamming of the sheet P between the fixing belt 201 and the pressure roller 203.

Inside the loop formed by the fixing belt 201 are the nip formation pad 206 and two lateral end heaters 226. The nip formation pad 206 is disposed opposite the pressure roller 203. The lateral end heaters 226 are mounted on or coupled with both lateral ends of the nip formation pad 206 in a longitudinal direction thereof, respectively. The lateral end heaters 226 heat the fixing belt 201 at the fixing nip N. Inside the loop formed by the fixing belt 201 are the thermal conduction aid 216 and a stay 207. The thermal conduction aid 216 covers a belt-side face of each of the nip formation pad 206 and the lateral end heaters 226, which is disposed opposite the inner circumferential surface of the fixing belt 201. The stay 207 serves as a support that supports the nip formation pad 206 and the thermal conduction aid 216 against pressure from the pressure roller 203.

Each of the nip formation pad 206, the thermal conduction aid 216, and the stay 207 has a width not smaller than a width of the fixing belt 201 in an axial direction or a longitudinal thereof parallel to a longitudinal direction of the nip formation pad 206, the thermal conduction aid 216, and the stay 207.

The thermal conduction aid 216 prevents heat generated by the lateral end heaters 226 from being stored locally and facilitates conduction of heat in the longitudinal direction of the thermal conduction aid 216, thus reducing uneven temperature of the fixing belt 201 in the axial direction thereof.

According to this exemplary embodiment, a belt-side face of the thermal conduction aid 216, which is disposed opposite the inner circumferential surface of the fixing belt 201, contacts the inner circumferential surface of the fixing belt 201 directly, thus serving as a nip formation face that forms the fixing nip N.

A detailed description is now given of a construction of the fixing belt 201.

The fixing belt 201 is an endless belt or film made of metal such as nickel and SUS stainless steel or resin such as polyimide. The fixing belt 201 is constructed of a base layer and a release layer. The release layer constituting an outer surface layer is made of perfluoroalkoxy alkane (PFA), polytetrafluoroethylene (PTFE), or the like to facilitate separation of toner of the toner image on the sheet P from the fixing belt 201, thus preventing the toner of the toner image from adhering to the fixing belt 201.

An elastic layer may be sandwiched between the base layer and the release layer and made of silicone rubber or the like. If the fixing belt 201 does not incorporate the elastic layer, the fixing belt 201 has a decreased thermal capacity that improves fixing property of being heated quickly to a desired fixing temperature at which the toner image is fixed on the sheet P. However, as the pressure roller 203 and the fixing belt 201 sandwich and press the toner image on the sheet P passing through the fixing nip N, slight surface asperities of the fixing belt 201 may be transferred onto the toner image on the sheet P, resulting in variation in gloss of the solid toner image that may appear as an orange peel image on the sheet P. To address this circumstance, the elastic layer made of silicone rubber has a thickness not smaller than 100 micrometers. As the elastic layer deforms, the elastic layer absorbs slight surface asperities of the fixing belt 201, preventing formation of the faulty orange peel image.

A detailed description is now given of a construction of the stay 207.

The stay 207 includes bases 207*d* and 207*f* and arms 207*a* and 207*b* projecting from the bases 207*d* and 207*f* and being disposed opposite the fixing nip N via the bases 207*d* and 207*f*, respectively. The first halogen heater 202A is disposed opposite the second halogen heater 202B via the arms 207*a* and 207*b* of the stay 207.

The first halogen heater 202A and the second halogen heater 202B emit light that irradiates the inner circumferential surface of the fixing belt 201 directly, thus heating the fixing belt 201 with radiation heat. The first halogen heater 202A and the second halogen heater 202B situated inside the loop formed by the fixing belt 201 render the fixing device 200 incorporating the fixing belt 201 serving as a rotatable, endless belt to be compact in size.

Inside the loop formed by the fixing belt 201 is the stay 207 serving as a support that supports the nip formation pad 206 to form the fixing nip N. As the nip formation pad 206 receives pressure from the pressure roller 203, the stay 207 supports the nip formation pad 206 to prevent bending of the nip formation pad 206 and produce an even nip length in the sheet conveyance direction DP throughout the entire width of the fixing belt 201 in the axial direction thereof.

The stay 207 is mounted on and held by flanges serving as a holder at both lateral ends of the stay 207 in the longitudinal direction thereof, thus being positioned inside the fixing device 200. A reflector 209 is interposed between the first halogen heater 202A and the stay 207 and another reflector 209 is interposed between the second halogen heater 202B and the stay 207. The reflectors 209 prevent heat and light radiated from the first halogen heater 202A and the second halogen heater 202B from heating the stay 207, suppressing waste of energy.

The fixing belt 201 and the components disposed inside the loop formed by the fixing belt 201, that is, the thermal conduction aid 216, the nip formation pad 206, the stay 207, the reflectors 209, the first halogen heater 202A, and the second halogen heater 202B, may construct a belt unit 201U separably coupled to the pressure roller 203.

Alternatively, instead of the reflectors 209, opposed faces 207*c* and 207*e* of the stay 207, which are disposed opposite the first halogen heater 202A and the second halogen heater 202B, respectively, may be treated with insulation or mirror finish to reflect light and heat radiated from the first halogen heater 202A and the second halogen heater 202B to the stay 207 toward the fixing belt 201.

A detailed description is now given of a construction of the pressure roller 203.

The pressure roller 203 is constructed of a core bar 205, an elastic rubber layer 204 coating the core bar 205, and a surface release layer coating the elastic rubber layer 204 and made of PFA or PTFE to facilitate separation of the sheet P from the pressure roller 203. As a driving force generated by a driver (e.g., a motor) situated inside the image forming apparatus 100 depicted in FIG. 1 is transmitted to the pressure roller 203 through a gear train, the pressure roller 203 rotates in the rotation direction D203. Alternatively, the driver may also be connected to the fixing belt 201 to drive and rotate the fixing belt 201. A spring or the like presses the pressure roller 203 against the nip formation pad 206 via the fixing belt 201. As the spring presses and deforms the elastic rubber layer 204 of the pressure roller 203, the pressure roller 203 produces the fixing nip N having the predetermined length in the sheet conveyance direction DP.

Alternatively, the pressure roller 203 may be a hollow roller that accommodates a heater such as a halogen heater.

The elastic rubber layer 204 may be made of solid rubber. Alternatively, if no heater is situated inside the pressure roller 203, the elastic rubber layer 204 may be made of sponge rubber. The sponge rubber is more preferable than the solid rubber because the sponge rubber has an increased insulation that draws less heat from the fixing belt 201.

As the pressure roller 203 rotates in the rotation direction D203, the fixing belt 201 rotates in the rotation direction D201 in accordance with rotation of the pressure roller 203 by friction therebetween. According to this exemplary embodiment illustrated in FIG. 2, as the driver drives and rotates the pressure roller 203, a driving force of the driver is transmitted from the pressure roller 203 to the fixing belt 201 at the fixing nip N, thus rotating the fixing belt 201 by friction between the pressure roller 203 and the fixing belt 201. At the fixing nip N, the fixing belt 201 rotates as the fixing belt 201 is sandwiched between the pressure roller 203 and the nip formation pad 206; at a circumferential span of the fixing belt 201 other than the fixing nip N, the fixing belt 201 rotates while the fixing belt 201 is guided by the flange at each lateral end of the fixing belt 201 in the axial direction thereof. With the construction described above, the fixing device 200 attaining quick warm-up is manufactured at reduced costs.

A description is provided of a construction of a first comparative fixing device.

The first comparative fixing device includes a fixing film, a heater disposed opposite an inner circumferential surface of the fixing film at a fixing nip, and a film guide that supports the heater. The film guide is a nip formation pad that presses against a pressure roller via the fixing film to form the fixing nip. The inner circumferential surface of the fixing film slides over an outer circumferential surface of the film guide and a heating surface of the heater.

A slide surface of the film guide over which the fixing film slides is applied with a lubricant. A plurality of guiding grooves extends linearly at a predetermined angle relative to a rotation direction of the fixing film. The plurality of guiding grooves is disposed downstream from the heater in the rotation direction of the fixing film.

The plurality of guiding grooves includes guiding grooves disposed at both lateral ends of the film guide in a longitudinal direction thereof and angled such that an end of each guiding groove is directed inward in a width direction of the fixing film along the rotation direction of the fixing film. Accordingly, as the fixing film rotates, the guiding grooves move the lubricant to a center of the fixing film, evenly dispersing the lubricant throughout the entire span from both lateral ends to a center of the film guide and the fixing film in an axial direction of the fixing film.

However, the lubricant may fail to enter a nip formed between the inner circumferential surface of the fixing film and the film guide and may move in the axial direction of the fixing film. As the lubricant moves in the axial direction of the fixing film, the lubricant may leak through an opening at one lateral end or both lateral ends of the fixing film in the axial direction thereof.

Figure 3:
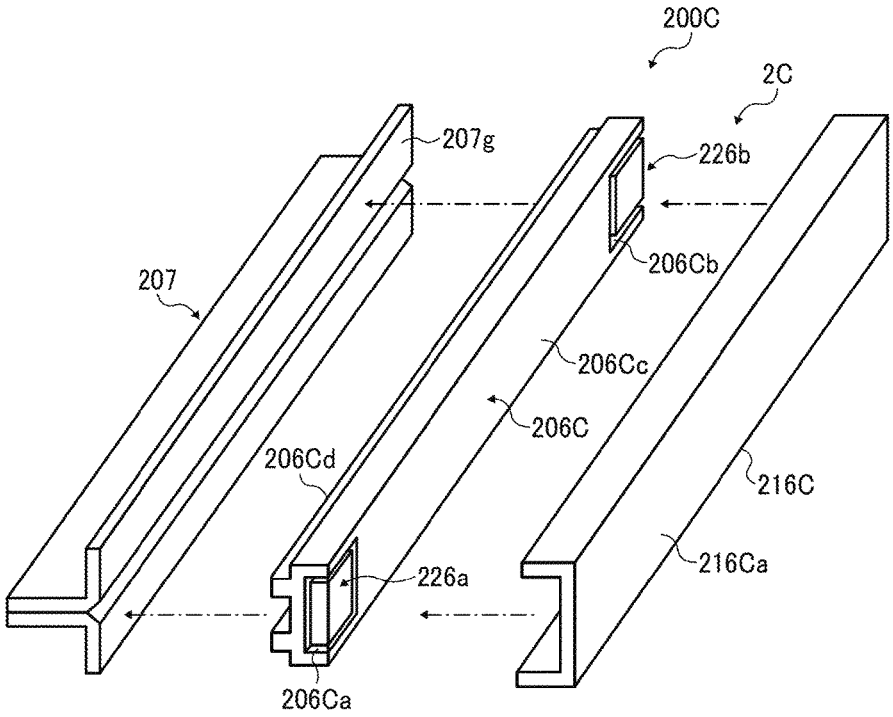
FIG. 3 is a perspective view of a nip former incorporated in a comparative fixing device.

Referring to FIG. 3, a description is provided of a construction of a second comparative fixing device 200C incorporating a nip former 2C including a nip formation pad 206C and a thermal conduction aid 216C.

FIG. 3 is a perspective view of the nip former 2C of the second comparative fixing device 200C. Identical reference numerals are assigned to identical components of the second comparative fixing device 200C, which are common to the components of the fixing device 200 depicted in FIG. 2 and description of the identical components is omitted.

As illustrated in FIG. 3, the nip formation pad 206C includes a belt-side face 206Cc disposed opposite the inner circumferential surface of the fixing belt 201 and a stay-side face 206Cd being opposite the belt-side face 206Cc and disposed opposite the stay 207. The stay 207 includes a belt-side face 207*g* disposed opposite the inner circumferential surface of the fixing belt 201. The stay-side face 206Cd of the nip formation pad 206C contacts the belt-side face 207*g* of the stay 207 to couple the nip formation pad 206C with the stay 207. For example, the stay-side face 206Cd of the nip formation pad 206C and the belt-side face 207*g* of the stay 207 mount a boss and a pin to couple the nip formation pad 206C with the stay 207. The thermal conduction aid 216C engages the nip formation pad 206C that is substantially rectangular such that the thermal conduction aid 216C covers the belt-side face 206Cc of the nip formation pad 206C that is disposed opposite the inner circumferential surface of the fixing belt 201. Thus, the thermal conduction aid 216C is coupled with the nip formation pad 206C. For example, the thermal conduction aid 216C is coupled with the nip formation pad 206C with a claw, an adhesive, or the like.

Two recesses 206Ca and 206Cb that define a step or a difference in thickness of the nip formation pad 206C are disposed at both lateral ends of the nip formation pad 206C in a longitudinal direction thereof. Lateral end heaters 226*a* and 226*b* are secured to the recesses 206Ca and 206Cb, thus being accommodated by the recesses 206Ca and 206Cb, respectively.

The thermal conduction aid 216C includes a belt-side face 216Ca, that is, a nip formation face, disposed opposite the inner circumferential surface of the fixing belt 201 and an outer circumferential surface of the pressure roller 203. However, since the belt-side face 206Cc of the nip formation pad 206C has a mechanical strength greater than a mechanical strength of the belt-side face 216Ca of the thermal conduction aid 216C, the belt-side face 206Cc serves as a nip formation face that forms the fixing nip N practically.

Figure 4:
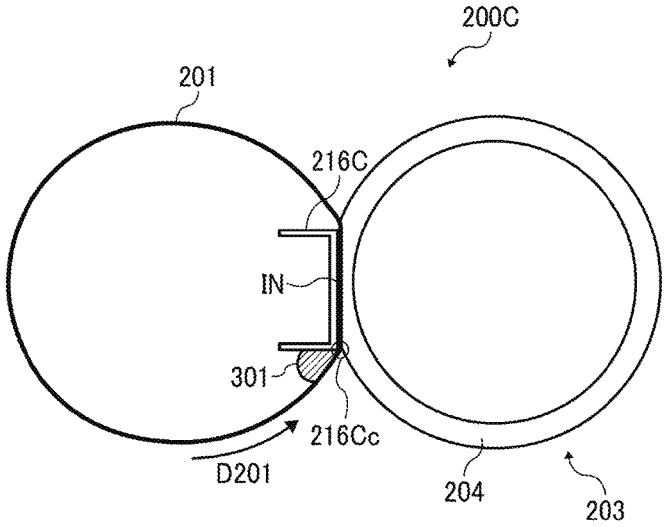
FIG. 4 is a schematic vertical cross-sectional view of the comparative fixing device depicted in FIG. 3.

FIG. 4 is a schematic vertical cross-sectional view of the second comparative fixing device 200C, illustrating a lubricant 301 on the nip former 2C. As illustrated in FIG. 4, as the fixing belt 201 rotates in the rotation direction D201, the lubricant 301 moves along a trajectory defined by the rotation direction D201 of the fixing belt 201 and enters an interior nip IN formed between the thermal conduction aid 216C and the fixing belt 201 by the nip formation pad 206C and the pressure roller 203 pressed against the nip formation pad 206C via the fixing belt 201. However, at an entry to the interior nip IN and a vicinity of the entry, the inner circumferential surface of the fixing belt 201 contacts an entry bent portion 216Cc of the thermal conduction aid 216C or a gap between the inner circumferential surface of the fixing belt 201 and the entry bent portion 216Cc of the thermal conduction aid 216C decreases sharply. Accordingly, the entry bent portion 216Cc of the thermal conduction aid 216C blocks most of the lubricant 301 moving on the trajectory defined by the rotation direction D201 of the fixing belt 201 and a part of the lubricant 301 enters the interior nip IN.

The lubricant 301 is blocked by the entry bent portion 216Cc with a resistive force that moves the lubricant 301 in a direction opposite the rotation direction D201 of the fixing belt 201 or the axial direction of the fixing belt 201. When the lubricant 301 moves in the axial direction of the fixing belt 201, if the lubricant 301 spreads evenly in the axial direction of the fixing belt 201 between the inner circumferential surface of the fixing belt 201 and the entry bent portion 216Cc of the thermal conduction aid 216C, the lubricant 301 is absent at an opening situated at a lateral end of the fixing belt 201 in the axial direction thereof. Accordingly, the fixing belt 201 receives no pressure in the axial direction thereof at the opening and the vicinity thereof on the fixing belt 201. Consequently, the lubricant 301 situated at a center of the fixing belt 201 in the axial direction thereof may flow gradually to the opening situated at the lateral end of the fixing belt 201 in the axial direction thereof.

A description is provided of a construction of the thermal conduction aid 216 of the fixing device 200 according to a first exemplary embodiment.

Figure 5A:
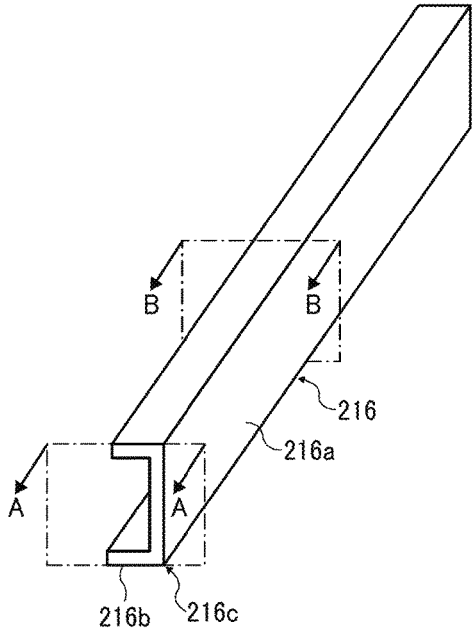
FIG. 5A is a perspective view of a thermal conduction aid according to a first exemplary embodiment, which is incorporated in the fixing device depicted in FIG. 2.
Figure 5B:
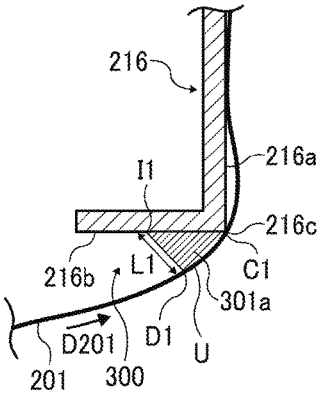
FIG. 5B is a cross-sectional view of the thermal conduction aid taken on a cross-section A-A of FIG. 5A.
Figure 5C:
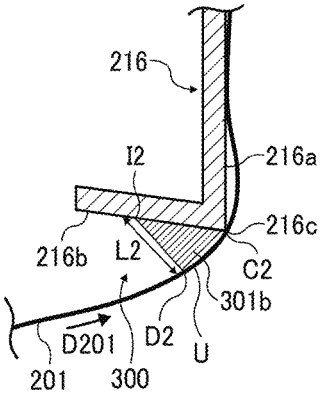
FIG. 5C is a cross-sectional view of the thermal conduction aid taken on a cross-section B-B of FIG. 5A.

FIG. 5A is a perspective view of the thermal conduction aid 216 according to the first exemplary embodiment. FIG. 5B is a cross-sectional view of the thermal conduction aid 216 taken on a cross-section A-A of FIG. 5A. FIG. 5C is a cross-sectional view of the thermal conduction aid 216 taken on a cross-section B-B of FIG. 5A. Identical reference numerals are assigned to identical components of the fixing device 200, which are common to the components of the second comparative fixing device 200C depicted in FIG. 3 and description of the identical components is omitted.

As illustrated in FIG. 5A, the thermal conduction aid 216 includes an opposed face 216*a*, an entry bent face 216*b*, and an entry bent portion 216*c*. The opposed face 216*a* serves as a first face that forms the fixing nip N depicted in FIG. 2. As the fixing belt 201 rotates, the inner circumferential surface of the fixing belt 201 slides over the opposed face 216*a* of the thermal conduction aid 216. As illustrated in FIG. 5B, the entry bent face 216*b* serves as a second face that is disposed upstream from an upstream end of the opposed face 216*a* in the rotation direction D201 of the fixing belt 201 and defines a predetermined angle relative to the opposed face 216*a*. The entry bent portion 216*c* serves as a bent portion that couples the opposed face 216*a* to the entry bent face 216*b*.

As illustrated in FIG. 5B, the entry bent face 216*b*, the entry bent portion 216*c*, and the inner circumferential surface of the fixing belt 201 define a lubricant accumulating space 300 where a lubricant U accumulates. The thermal conduction aid 216 adjusts an amount of the lubricant U accumulated in a center portion of the lubricant accumulating space 300 disposed opposite a center of the thermal conduction aid 216 in the axial direction of the fixing belt 201 to be greater than an amount of the lubricant U accumulated in a lateral end portion of the lubricant accumulating space 300 disposed opposite a lateral end of the thermal conduction aid 216 in the axial direction of the fixing belt 201.

For example, the thermal conduction aid 216 defines a distance L from an intersection, where a normal line of the inner circumferential surface of the fixing belt 201 intersects the entry bent face 216*b*, to the inner circumferential surface of the fixing belt 201 as described below. As illustrated in FIG. 5B, the distance L is a distance L1 from an intersection I1, where the normal line of the inner circumferential surface of the fixing belt 201 intersects the entry bent face 216*b*, to the inner circumferential surface of the fixing belt 201 at the lateral end of the thermal conduction aid 216 in the longitudinal direction thereof. As illustrated in FIG. 5C, the distance L is a distance L2 from an intersection I2, where the normal line of the inner circumferential surface of the fixing belt 201 intersects the entry bent face 216*b*, to the inner circumferential surface of the fixing belt 201 at the center of the thermal conduction aid 216 in the longitudinal direction thereof. The entry bent face 216*b* is angled relative to the opposed face 216*a* such that the distance L1 is smaller than the distance L2.

Accordingly, as illustrated in FIG. 5B, at the lateral end of the thermal conduction aid 216 in the longitudinal direction thereof, the thermal conduction aid 216 defines a lateral end accumulation portion 301*a* having a cross-sectional area of a gap defined by the fixing belt 201 and the entry bent portion 216*c* from a contact point C1 where the fixing belt 201 contacts the entry bent portion 216*c* to a point D1 spaced apart from the contact point C1 in a direction opposite the rotation direction D201 of the fixing belt 201. As illustrated in FIG. 5C, at the center of the thermal conduction aid 216 in the longitudinal direction thereof, the thermal conduction aid 216 defines a center accumulation portion 301*b* having a cross-sectional area of a gap defined by the fixing belt 201 and the entry bent portion 216*c* from a contact point C2 where the fixing belt 201 contacts the entry bent portion 216*c* to a point D2 spaced apart from the contact point C2 in the direction opposite the rotation direction D201 of the fixing belt 201. The cross-sectional area of the center accumulation portion 301*b* is greater than the cross-sectional area of the lateral end accumulation portion 301*a*.

A capacity of the lubricant accumulating space 300 where the lubricant U accumulates increases from the lateral end portion to the center portion of the lubricant accumulating space 300 in the longitudinal direction of the thermal conduction aid 216. The thermal conduction aid 216 produces a pressure gradient in which pressure exerted to the lubricant U accumulated in the center portion of the lubricant accumulating space 300 disposed opposite the center of the thermal conduction aid 216 in the axial direction of the fixing belt 201 is smaller than pressure exerted to the lubricant U accumulated in the lateral end portion of the lubricant accumulating space 300 disposed opposite the lateral end of the thermal conduction aid 216 in the axial direction of the fixing belt 201. The pressure gradient moves the lubricant U from the lateral end to the center of the thermal conduction aid 216 in the axial direction of the fixing belt 201. Accordingly, the pressure gradient suppresses leakage of the lubricant U from the lateral end of the fixing belt 201 in the axial direction thereof.

Figure 6:
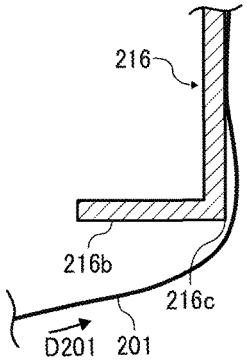
FIG. 6 is a cross-sectional view of a fixing belt incorporated in the fixing device depicted in FIG. 2 and the thermal conduction aid depicted in FIG. 5A.

FIG. 6 is a cross-sectional view of the fixing belt 201 and the thermal conduction aid 216, illustrating the inner circumferential surface of the fixing belt 201 isolated from the entry bent portion 216*c* of the thermal conduction aid 216.

If a width of the nip formation pad 206 depicted in FIG. 2 is small relative to a loop diameter of the fixing belt 201, tension of the fixing belt 201 is weak as illustrated in FIG. 6. Accordingly, the inner circumferential surface of the fixing belt 201 may not contact the entry bent portion 216*c* of the thermal conduction aid 216. In this case also, the gap between the fixing belt 201 and the entry bent face 216*b* is minimum at the entry bent portion 216*c*.

An amount of the lubricant entering a fixing nip gap between the fixing belt 201 and the thermal conduction aid 216 at the fixing nip N when the inner circumferential surface of the fixing belt 201 is isolated from the entry bent portion 216*c* is greater than an amount of the lubricant entering the fixing nip gap when the inner circumferential surface of the fixing belt 201 contacts the entry bent portion 216*c*. However, the entry bent portion 216*c* blocks the lubricant to accumulate most of the lubricant in the gap between the fixing belt 201 and the entry bent face 216*b*. The cross-sectional area of the center accumulation portion 301*b* is greater than the cross-sectional area of the lateral end accumulation portion 301*a*, thus moving the lubricant to the center portion of the thermal conduction aid 216 in the longitudinal direction thereof as described above.

A description is provided of a construction of a thermal conduction aid 316 according to a second exemplary embodiment.

Figure 7A:
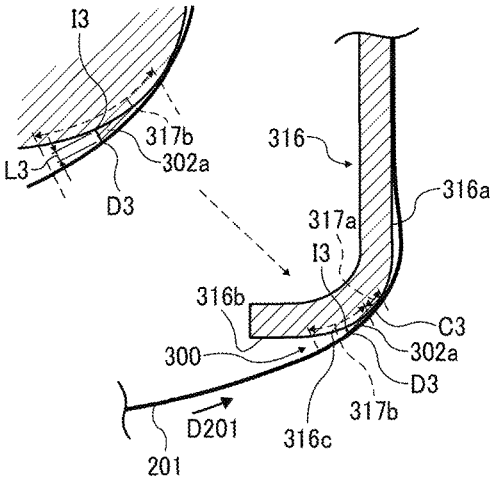
FIG. 7A is a cross-sectional view of a thermal conduction aid according to a second exemplary embodiment, which is installable in the fixing device depicted in FIG. 2, at a lateral end of the thermal conduction aid in a longitudinal direction thereof.
Figure 7B:
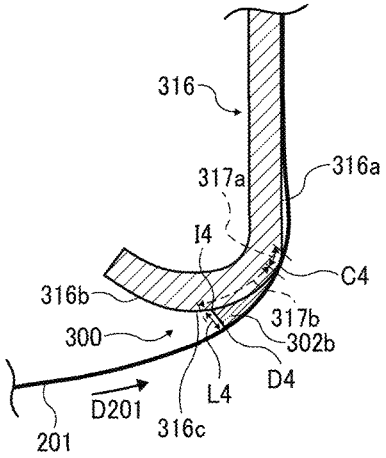
FIG. 7B is a cross-sectional view of the thermal conduction aid depicted in FIG. 7A at a center of the thermal conduction aid in the longitudinal direction thereof.

FIG. 7A is a cross-sectional view of the thermal conduction aid 316 at a lateral end of the thermal conduction aid 316 in a longitudinal direction thereof. FIG. 7B is a cross-sectional view of the thermal conduction aid 316 at a center of the thermal conduction aid 316 in the longitudinal direction thereof. Identical reference numerals are assigned to identical components of the thermal conduction aid 316, which are common to the components of the thermal conduction aid 216 according to the first exemplary embodiment depicted in FIGS. 5A, 5B, and 5C and description of the identical components is omitted.

The thermal conduction aid 316 according to the second exemplary embodiment is different from the thermal conduction aid 216 according to the first exemplary embodiment in that the thermal conduction aid 316 includes an entry bent portion 316*c* that is curved. As illustrated in FIGS. 7A and 7B, the thermal conduction aid 316 includes an opposed face 316*a* disposed opposite the inner circumferential surface of the fixing belt 201; an entry bent face 316*b* disposed upstream from the opposed face 316*a* in the rotation direction D201 of the fixing belt 201; and the entry bent portion 316*c* coupling the opposed face 316*a* with the entry bent face 316*b*.

Since the entry bent portion 316*c* is curved, the entry bent portion 316*c* contacts the inner circumferential surface of the fixing belt 201 linearly. The entry bent portion 316*c* contacting the inner circumferential surface of the fixing belt 201 linearly reduces a load imposed on the inner circumferential surface of the fixing belt 201 compared to the entry bent portion 216*c* contacting the inner circumferential surface of the fixing belt 201 at a point.

The entry bent portion 316*c* that is curved includes a contact portion 317*a* and a non-contact portion 317*b* disposed opposite the inner circumferential surface of the fixing belt 201. The contact portion 317*a* contacts the inner circumferential surface of the fixing belt 201. The non-contact portion 317*b* is isolated from the inner circumferential surface of the fixing belt 201. The lubricant accumulates on the non-contact portion 317*b* of the entry bent portion 316*c*.

A curve of the entry bent portion 316*c* of the thermal conduction aid 316 is changed to define the distance L from an intersection, where the normal line of the inner circumferential surface of the fixing belt 201 intersects the non-contact portion 317*b* of the entry bent portion 316*c*, to the inner circumferential surface of the fixing belt 201 as described below. As illustrated in FIG. 7A, the distance L is a distance L3 from an intersection I3, where the normal line of the inner circumferential surface of the fixing belt 201 intersects the entry bent face 316*b*, to the inner circumferential surface of the fixing belt 201 at the lateral end of the thermal conduction aid 316 in the longitudinal direction thereof. As illustrated in FIG. 7B, the distance L is a distance L4 from an intersection I4, where the normal line of the inner circumferential surface of the fixing belt 201 intersects the entry bent face 316*b*, to the inner circumferential surface of the fixing belt 201 at the center of the thermal conduction aid 316 in the longitudinal direction thereof. The distance L is maximum at an arbitrary position on the thermal conduction aid 316 in the axial direction of the fixing belt 201. The distance L decreases from the arbitrary position to the lateral end of the thermal conduction aid 316 in the axial direction of the fixing belt 201.

In the non-contact portion 317*b*, an area of a gap between the inner circumferential surface of the fixing belt 201 and the entry bent portion 316*c* is defined as below. As illustrated in FIG. 7A, at the lateral end of the thermal conduction aid 316 in the longitudinal direction thereof, the thermal conduction aid 316 defines a cross-sectional area of a lateral end accumulation portion 302*a* of a gap defined by the fixing belt 201 and the entry bent portion 316*c* from a contact point C3 where the fixing belt 201 contacts the entry bent portion 316*c* to a point D3 spaced apart from the contact point C3 in the direction opposite the rotation direction D201 of the fixing belt 201. As illustrated in FIG. 7B, at the center of the thermal conduction aid 316 in the longitudinal direction thereof, the thermal conduction aid 316 defines a cross-sectional area of a center accumulation portion 302*b* of a gap defined by the fixing belt 201 and the entry bent portion 316*c* from a contact point C4 where the fixing belt 201 contacts the entry bent portion 316*c* to a point D4 spaced apart from the contact point C4 in the direction opposite the rotation direction D201 of the fixing belt 201. The cross-sectional area of the center accumulation portion 302*b* is greater than the cross-sectional area of the lateral end accumulation portion 302*a*.

A capacity of the lubricant accumulating space 300 where the lubricant accumulates increases from the lateral end portion to the center portion of the lubricant accumulating space 300 in the longitudinal direction of the thermal conduction aid 316. Accordingly, like the thermal conduction aid 216 as described above in the first exemplary embodiment, the thermal conduction aid 316 suppresses leakage of the lubricant from the lateral end of the fixing belt 201 in the axial direction thereof.

A description is provided of a construction of a thermal conduction aid 416 according to a third exemplary embodiment.

Figure 8A:
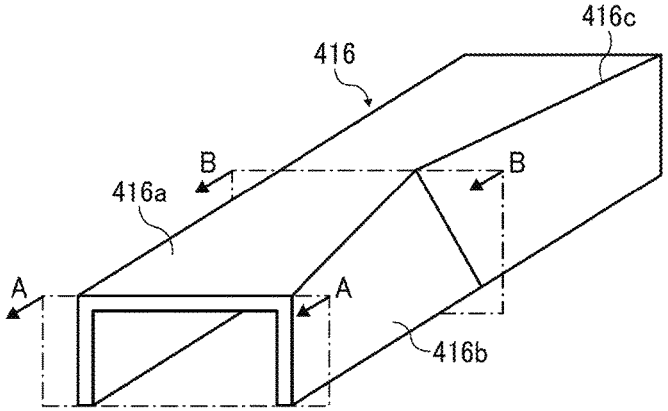
FIG. 8A is a perspective view of a thermal conduction aid according to a third exemplary embodiment, which is installable in the fixing device depicted in FIG. 2.
Figure 8B:
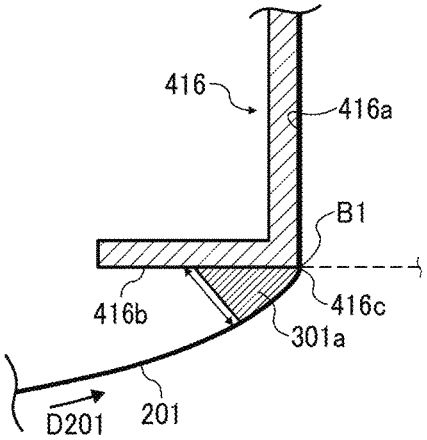
FIG. 8B is a cross-sectional view of the thermal conduction aid taken on a cross-section A-A of FIG. 8A.
Figure 8C:
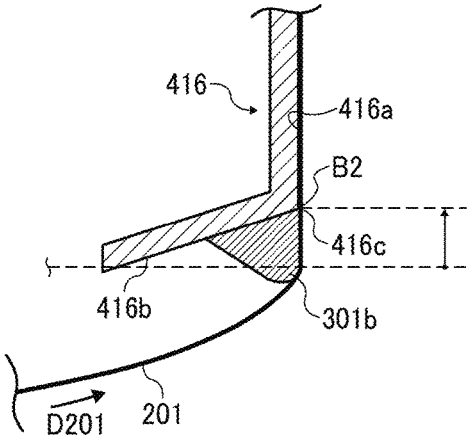
FIG. 8C is a cross-sectional view of the thermal conduction aid taken on a cross-section B-B of FIG. 8A.

FIG. 8A is a perspective view of the thermal conduction aid 416 according to the third exemplary embodiment. FIG. 8B is a cross-sectional view of the thermal conduction aid 416 taken on a cross-section A-A of FIG. 8A. FIG. 8C is a cross-sectional view of the thermal conduction aid 416 taken on a cross-section B-B of FIG. 8A. Identical reference numerals are assigned to identical components of the thermal conduction aid 416, which are common to the components of the thermal conduction aid 216 according to the first exemplary embodiment depicted in FIGS. 5A, 5B, and 5C and description of the identical components is omitted.

The thermal conduction aid 416 according to the third exemplary embodiment is different from the thermal conduction aid 216 according to the first exemplary embodiment depicted in FIGS. 5A, SB, and SC in that a bent start position of an entry bent portion 416*c* varies in a longitudinal direction of the thermal conduction aid 416. As illustrated in FIG. 8A, the thermal conduction aid 416 includes an opposed face 416*a* disposed opposite the inner circumferential surface of the fixing belt 201; an entry bent face 416*b* disposed upstream from the opposed face 416*a* in the rotation direction D201 of the fixing belt 201; and the entry bent portion 416*c* coupling the opposed face 416*a* with the entry bent face 416*b*.

As illustrated in FIGS. 8A, 8B, and 8C, the thermal conduction aid 416 according to the third exemplary embodiment has the bent start position of the entry bent portion 416*c* defined as below. A bent start position B2 of the entry bent portion 416*c* at a center of the thermal conduction aid 416 in the longitudinal direction thereof illustrated in FIG. 8C is disposed downstream from a bent start position B1 of the entry bent portion 416*c* at a lateral end of the thermal conduction aid 416 in the longitudinal direction thereof illustrated in FIG. 8B in the rotation direction D201 of the fixing belt 201.

Figure 9:
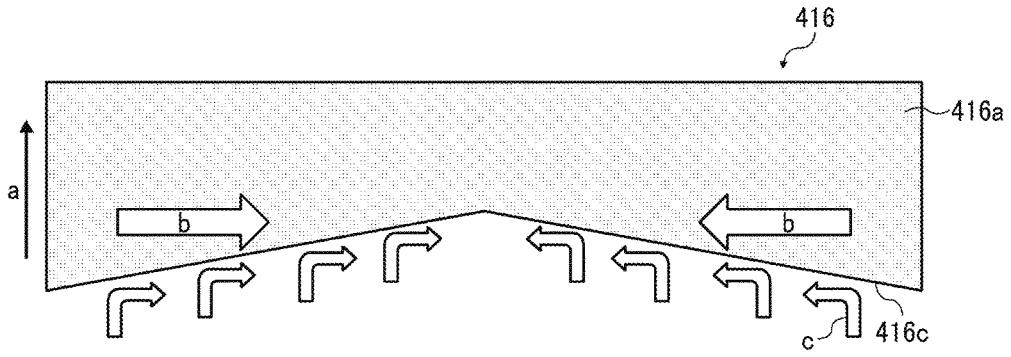
FIG. 9 is a plan view of the thermal conduction aid depicted in FIG. 8A.

FIG. 9 is a plan view of the thermal conduction aid 416 for explaining a moving direction of the lubricant. As illustrated in FIG. 9, the bent start position of the entry bent portion 416*c* changes in a direction a, thus varying in the axial direction of the fixing belt 201. A ridge of the entry bent portion 416*c* slants toward the center of the thermal conduction aid 416 in directions b, that is, the longitudinal direction of the thermal conduction aid 416. The inner circumferential surface of the fixing belt 201 and the thermal conduction aid 416 define a block position at which the fixing belt 201 and the thermal conduction aid 416 block the lubricant. The block position slants toward the center of the thermal conduction aid 416 in the directions b, that is, the longitudinal direction of the thermal conduction aid 416, parallel to the axial direction of the fixing belt 201. A resistance imposed on the lubricant to block the lubricant is directed in the directions b from the lateral end to the center of the thermal conduction aid 416 in the longitudinal direction thereof, thus moving the lubricant in a moving direction c toward the center of the thermal conduction aid 416 in the longitudinal direction thereof.

A cross-sectional area defined by the fixing belt 201 and the entry bent portion 416*c* of the thermal conduction aid 416 increases from the lateral end to the center of the thermal conduction aid 416 in the longitudinal direction thereof. That is, a cross-sectional area of the center accumulation portion 301*b* is greater than a cross-sectional area of the lateral end accumulation portion 301*a*. Accordingly, the pressure gradient generates as described above, facilitating movement of the lubricant from the lateral end to the center of the thermal conduction aid 416 in the axial direction of the fixing belt 201.

Even if the entry bent portion 416*c* is curved, a contact region where the entry bent portion 416*c* contacts the fixing belt 201 has a side that is angled relative to the longitudinal direction of the thermal conduction aid 416 toward the center of the thermal conduction aid 416 in the longitudinal direction thereof parallel to the axial direction of the fixing belt 201. Accordingly, the thermal conduction aid 416 attains advantages equivalent to the advantages described above.

A description is provided of a construction of a thermal conduction aid 516 according to a fourth exemplary embodiment.

Figure 10A:
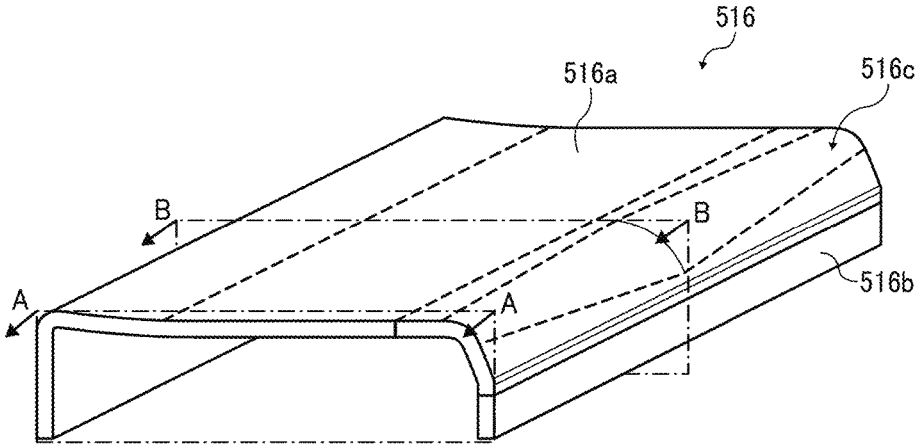
FIG. 10A is a perspective view of a thermal conduction aid according to a fourth exemplary embodiment, which is installable in the fixing device depicted in FIG. 2.
Figure 10B:
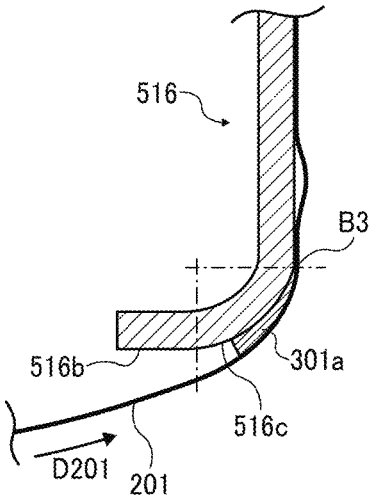
FIG. 10B is a cross-sectional view of the thermal conduction aid taken on a cross-section A-A of FIG. 10A.
Figure 10C:
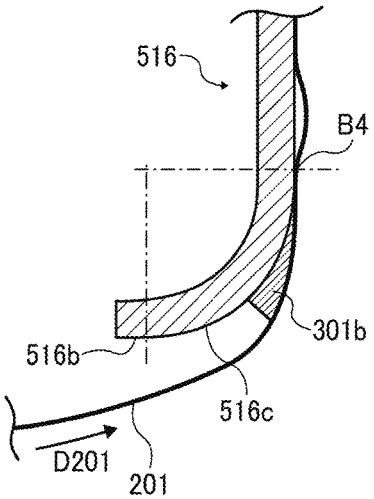
FIG. 10C is a cross-sectional view of the thermal conduction aid taken on a cross-section B-B of FIG. 10A.

FIG. 10A is a perspective view of the thermal conduction aid 516 according to the fourth exemplary embodiment. FIG. 10B is a cross-sectional view of the thermal conduction aid 516 taken on a cross-section A-A of FIG. 10A. FIG. 10C is a cross-sectional view of the thermal conduction aid 516 taken on a cross-section B-B of FIG. 10A. Identical reference numerals are assigned to identical components of the thermal conduction aid 516, which are common to the components of the thermal conduction aid 416 according to the third exemplary embodiment depicted in FIGS. 8A, 8B, and 8C and description of the identical components is omitted.

The thermal conduction aid 516 according to the fourth exemplary embodiment is different from the thermal conduction aid 416 according to the third exemplary embodiment in that the thermal conduction aid 516 includes an entry bent portion 516*c* that is curved.

As illustrated in FIG. 10A, like the thermal conduction aid 416 according to the third exemplary embodiment, a bent start position B4 of the entry bent portion 516*c* at a center of the thermal conduction aid 516 in a longitudinal direction thereof illustrated in FIG. 10C is disposed downstream from a bent start position B3 of the entry bent portion 516*c* at a lateral end of the thermal conduction aid 516 in the longitudinal direction thereof illustrated in FIG. 10B in the rotation direction D201 of the fixing belt 201. The entry bent portion 516*c* of the thermal conduction aid 516 is curved. A radius of curvature of the entry bent portion 516*c* that is curved increases toward the center of the thermal conduction aid 516 in the longitudinal direction of the thermal conduction aid 516. That is, a radius of curvature of a center of the entry bent portion 516*c* in the axial direction of the fixing belt 201 is greater than a radius of curvature of a lateral end of the entry bent portion 516*c* in the axial direction of the fixing belt 201.

In a state in which an angle of an entry bent face 516*b* relative to an opposed face 516*a* is uniform in the longitudinal direction of the thermal conduction aid 516, a pressure gradient generates from the lateral end to the center of the thermal conduction aid 516 in the longitudinal direction thereof. Additionally, a block force to block the lubricant is directed to the center of the thermal conduction aid 516 in the longitudinal direction thereof, thus facilitating movement of the lubricant from the lateral end to the center of the thermal conduction aid 516 in the longitudinal direction thereof.

If the angle of the entry bent face 516*b* relative to the opposed face 516*a* varies in the longitudinal direction of the thermal conduction aid 516, in order to engage the thermal conduction aid 516 with the nip formation pad 206 precisely, an entry portion of the nip formation pad 206, which is disposed opposite an entry to the fixing nip N is requested to change in shape in the longitudinal direction of the nip formation pad 206 like the thermal conduction aid 516. Hence, manufacturing or processing of the nip formation pad 206 may be complicated. However, since the thermal conduction aid 516 prevents the angle of the entry bent face 516*b* relative to the opposed face 516*a* from varying in the longitudinal direction of the thermal conduction aid 516, the entry bent face 516*b* is planar, allowing the nip formation pad 206 to engage the thermal conduction aid 516 while the nip formation pad 206 has a shape that is processed readily.

The exemplary embodiments described above are one example and attain advantages below in a plurality of aspects below.

A description is provided of advantages of the fixing device 200 in an aspect A.

As illustrated in FIG. 2, a fixing device (e.g., the fixing device 200) includes a rotator (e.g., the fixing belt 201), an abutment (e.g., the pressure roller 203), and a nip former (e.g., a nip former 2 including the nip formation pad 206 and the thermal conduction aid 216). The rotator is an endless belt rotatable in a rotation direction (e.g., the rotation direction D201). The abutment contacts or presses against an outer circumferential surface of the rotator. The nip former is disposed inside the rotator and presses against the abutment via the rotator to form a fixing nip (e.g., the fixing nip N) between the rotator and the abutment, through which a recording medium (e.g., a sheet P) bearing a toner image is conveyed.

As illustrated in FIGS. 5B and 5C, a lubricant (e.g., the lubricant U) is interposed between an inner circumferential surface of the rotator and the nip former. As illustrated in FIGS. 5A, 7A, 8A, and 10A, the nip former includes a first face (e.g., the opposed faces 216*a*, 316*a*, 416*a*, and 516*a*), a second face (e.g., the entry bent faces 216*b*, 316*b*, 416*b*, and 516*b*), and a bent portion (e.g., the entry bent portions 216*c*, 316*c*, 416*c*, and 516*c*).

The first face forms the fixing nip such that the inner circumferential surface of the rotator slides over the first face. The second face is disposed upstream from the first face in the rotation direction of the rotator and defines a predetermined angle relative to the first face. The bent portion couples the first face with the second face. The second face and the bent portion of the nip former and the inner circumferential surface of the rotator define a lubricant accumulating space (e.g., the lubricant accumulating space 300). The second face and the bent portion of the nip former and the inner circumferential surface of the rotator define a lateral end accumulation portion (e.g., the lateral end accumulation portions 301*a* and 302*a*) and a center accumulation portion (e.g., the center accumulation portions 301*b* and 302*b*) disposed inboard from the lateral end accumulation portion in an axial direction of the rotator. The lateral end accumulation portion is accumulated with the lubricant in a first amount. The center accumulation portion is accumulated with the lubricant in a second amount greater than the first amount.

The amount of the lubricant accumulated in the lubricant accumulating space defined by the second face and the bent portion of the nip former and the inner circumferential surface of the rotator is adjusted such that the second amount of the lubricant accumulated in the center accumulation portion is greater than the first amount of the lubricant accumulated in the lateral end accumulation portion. Accordingly, a pressure gradient in which pressure generated in the center accumulation portion is smaller than pressure generated in the lateral end accumulation portion is produced in the lubricant accumulating space. The pressure gradient moves the lubricant from the lateral end accumulation portion to the center accumulation portion of the nip former in the axial direction of the rotator, suppressing leakage of the lubricant from a lateral end of the rotator in the axial direction thereof, which may occur as the lubricant moves in the axial direction of the rotator.

A description is provided of advantages of the fixing device 200 in an aspect B.

According to the fixing device in the aspect A, as illustrated in FIG. 2, the fixing device further includes a heat generator (e.g., the first halogen heater 202A and the second halogen heater 202B) and a support (e.g., the stay 207).

The heat generator is disposed inside the rotator. The support contacts a support-side face (e.g., a stay-side face 206*d*) of the nip former opposite the first face of the nip former. The support supports the nip former.

The nip former includes a base (e.g., the nip formation pad 206) and a thermal conductor (e.g., the thermal conduction aid 216). The thermal conductor is interposed between the base and the inner circumferential surface of the rotator and has a first thermal conductivity greater than a second thermal conductivity of the base. The thermal conductor includes the first face, the second face, and the bent portion. The nip former defines a first distance (e.g., the distance L) from an intersection (e.g., the intersections I1, I2, I3, and I4), where a normal line of the inner circumferential surface of the rotator intersects the second face, to the inner circumferential surface of the rotator. The first distance is maximum at an arbitrary position on the nip former in the axial direction of the rotator. The first distance decreases from the arbitrary position to the lateral end accumulation portion defined by the nip former in the axial direction of the rotator.

Accordingly, as described above in the exemplary embodiments, the amount of the lubricant accumulated in the lubricant accumulating space defined by the second face and the bent portion of the nip former and the inner circumferential surface of the rotator is adjusted such that the first amount of the lubricant accumulated in the center accumulation portion is greater than the second amount of the lubricant accumulated in the lateral end accumulation portion.

A description is provided of advantages of the fixing device 200 in an aspect C.

According to the fixing device in the aspect A or B, the bent portion (e.g., the entry bent portion 216*c*) contacts the inner circumferential surface of the rotator. The nip former defines the first distance from the intersection, where the normal line of the inner circumferential surface of the rotator intersects the second face, to the inner circumferential surface of the rotator. The first distance increases from the bent portion to an upstream position upstream from the bent portion in the rotation direction of the rotator. Each of the lateral end accumulation portion and the center accumulation portion facilitates slipping of the lubricant through a gap between the nip former and the rotator by wedge effect.

A description is provided of advantages of the fixing device 200 in an aspect D.

According to the fixing device in the aspect A or B, the bent portion is isolated from the inner circumferential surface of the rotator. The nip former defines the first distance from the intersection, where the normal line of the inner circumferential surface of the rotator intersects the second face, to the inner circumferential surface of the rotator. The first distance is minimum at the bent portion in the rotation direction of the rotator. The first distance increases from the bent portion to the upstream position upstream from the bent portion in the rotation direction of the rotator.

A description is provided of advantages of the fixing device 200 in an aspect E.

According to the fixing device in any one of the aspects A to D, as illustrated in FIGS. 7A and 7B, the bent portion (e.g., the entry bent portion 316*c*) is curved. As described above in the second exemplary embodiment depicted in FIGS. 7A and 7B, since the bent portion is curved, the bent portion decreases a load imposed on the inner circumferential surface of the rotator compared to a configuration in which the bent portion contacts the rotator at a point.

A description is provided of advantages of the fixing device 200 in an aspect F.

According to the fixing device in the aspect E, the bent portion (e.g., the entry bent portion 316*c*) includes a contact portion (e.g., the contact portion 317*a*). The contact portion abuts on the first face in the rotation direction of the rotator. The contact portion contacts the inner circumferential surface of the rotator. The bent portion further includes a non-contact portion (e.g., the non-contact portion 317*b*) abutting on the second face in the rotation direction of the rotator. The non-contact portion is isolated from the inner circumferential surface of the rotator.

The nip former defines a second distance from an intersection (e.g., the intersections I3 and I4), where the normal line of the inner circumferential surface of the rotator intersects the non-contact portion, to the inner circumferential surface of the rotator. The second distance is maximum at an arbitrary position on the nip former in the axial direction of the rotator. The second distance decreases from the arbitrary position to the lateral end accumulation portion defined by the nip former in the axial direction of the rotator.

A description is provided of advantages of the fixing device 200 in an aspect G.

According to the fixing device in the aspect F, the nip former defines the second distance from the intersection, where the normal line of the inner circumferential surface of the rotator intersects the non-contact portion, to the inner circumferential surface of the rotator. The second distance increases from the contact portion to the upstream position upstream from the contact portion in the rotation direction of the rotator.

A description is provided of advantages of the fixing device 200 in an aspect H.

According to the fixing device in any one of the aspects A to G, as illustrated in FIGS. 8B and 8C, a bent start position (e.g., the bent start positions B1 and B2) of the bent portion (e.g., the entry bent portion 416*c*) deviates upstream in the rotation direction of the rotator from an arbitrary position on the nip former to the lateral end accumulation portion in the axial direction of the rotator.

As described above in the third exemplary embodiment, a ridge of the bent portion slants from a lateral end to a center of the nip former in the axial direction of the rotator. Accordingly, a block position of the lubricant defined by the inner circumferential surface of the rotator and the bent portion changes to produce a slope from the lateral end to the center of the nip former in the axial direction of the rotator. A resistance imposed on the lubricant to block the lubricant is directed in a direction from the lateral end to the center of the nip former in the axial direction of the rotator, thus facilitating movement of the lubricant toward the center of the nip former in the axial direction of the rotator.

A description is provided of advantages of the fixing device 200 in an aspect I.

According to the fixing device in any one of the aspects E to H, a radius of curvature of the bent portion that is curved decreases from an arbitrary position on the nip former in the rotation direction of the rotator, at which the radius of curvature is maximum, to the lateral end accumulation portion defined by the nip former (e.g., the thermal conduction aid 416) in the axial direction of the rotator.

A description is provided of advantages of the fixing device 200 in an aspect J.

According to the fixing device in the aspect A, as illustrated in FIG. 2, the fixing device includes the heat generator (e.g., the first halogen heater 202A and the second halogen heater 202B) and the support (e.g., the stay 207). The heat generator is disposed inside the loop formed by the rotator. The support contacts the support-side face of the nip former opposite the first face of the nip former. The support supports the nip former. The nip former includes the base and the thermal conductor.

The thermal conductor is interposed between the base and the inner circumferential surface of the rotator and has the first thermal conductivity greater than the second thermal conductivity of the base. The thermal conductor includes the first face, the second face, and the bent portion. The bent portion is curved. The bent portion includes the contact portion abutting on the first face in the rotation direction of the rotator. The contact portion contacts the inner circumferential surface of the rotator. The bent portion further includes the non-contact portion abutting on the second face in the rotation direction of the rotator. The non-contact portion is isolated from the inner circumferential surface of the rotator. The thermal conductor defines the second distance from the intersection, where the normal line of the inner circumferential surface of the rotator intersects the non-contact portion, to the inner circumferential surface of the rotator. The second distance is maximum at an arbitrary position on the nip former in the axial direction of the rotator. The second distance decreases from the arbitrary position to the lateral end accumulation portion defined by the nip former in the axial direction of the rotator.

A description is provided of advantages of the fixing device 200 in an aspect K.

According to the fixing device in the aspect J, the radius of curvature of the bent portion decreases from an arbitrary position on the nip former in the rotation direction of the rotator, at which the radius of curvature is maximum, to the lateral end accumulation portion defined by the nip former in the axial direction of the rotator.

A description is provided of advantages of the fixing device 200 in an aspect L.

According to the fixing device in the aspect J or K, as illustrated in FIGS. 10A, 10B, and 10C, the bent portion (e.g., the bent portion 516*c*) is curved. The bent start position of the bent portion of the nip former deviates upstream in the rotation direction of the rotator from an arbitrary position on the nip former to the lateral end accumulation portion defined by the nip former in the axial direction of the rotator.

A description is provided of advantages of the fixing device 200 in an aspect M.

As illustrated in FIG. 1, an image forming apparatus (e.g., the image forming apparatus 100) includes the fixing device that fixes a toner image on a recording medium. The fixing device attains any one of the aspects A to L.

The fixing device suppresses leakage of the lubricant from the lateral end of the rotator in the axial direction thereof, which may occur as the lubricant moves in the axial direction of the rotator. Accordingly, the fixing device prevents the lubricant from adhering to the outer circumferential surface of the rotator and therefore prevents degradation in separation of the recording medium from the rotator. Additionally, the fixing device prevents the lubricant from adhering to a surface of the recording medium and therefore prevents the lubricant from scratching the toner image on the recording medium, thus suppressing degradation in quality of the toner image formed on the recording medium.

According to the exemplary embodiments described above, the fixing belt 201 serves as a rotator. Alternatively, a fixing film, a fixing sleeve, or the like may be used as a rotator. Further, the pressure roller 203 serves as an abutment. Alternatively, a pressure belt or the like may be used as an abutment.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt rotatable in a rotation direction;

an abutment contacting an outer circumferential surface of the fixing belt;

a nip formation pad, disposed inside the fixing belt, to press in a pressing direction against the abutment via the fixing belt to form a fixing nip between the fixing belt and the abutment, the nip formation pad to bear a lubricant interposed between the nip formation pad and an inner circumferential surface of the fixing belt, the nip formation pad including:

a first face to form the fixing nip, the first face over which the inner circumferential surface of the fixing belt slides;

a second face being disposed upstream from the first face in the rotation direction of the fixing belt and defining a predetermined angle relative to the first face, the second face including an entry bent face that is bent at a bend line at a center in a longitudinal direction of the nip formation pad, at least a portion of the bend line extending out of a plane formed by the pressing direction and the longitudinal direction; and a bent portion coupling the first face to the second face;

a lateral end accumulation portion defined by the second face and the bent portion of the nip formation pad and the inner circumferential surface of the fixing belt and accumulated with the lubricant in a first amount; and a center accumulation portion defined by the second face and the bent portion of the nip formation pad and the inner circumferential surface of the fixing belt and disposed inboard from the lateral end accumulation portion in an axial direction of the fixing belt, the center accumulation portion being accumulated with the lubricant in a second amount greater than the first amount, wherein the lateral end accumulation portion and the center accumulation portion each extend to a start point of the first face that forms the fixing nip.

2. The fixing device according to claim 1, further comprising:

a heater disposed inside the fixing belt; and a support supporting the nip formation pad, wherein the nip formation pad further includes a support-side face being opposite the first face and contacting the support.

3. The fixing device according to claim 2, wherein the nip formation pad further includes:

a base having a first thermal conductivity; and a thermal conductor being interposed between the base and the inner circumferential surface of the fixing belt and having a second thermal conductivity greater than the first thermal conductivity of the base, the thermal conductor including the first face, the second face, and the bent portion.

4. The fixing device according to claim 1, wherein the nip formation pad defines a first distance from an intersection to the inner circumferential surface of the fixing belt, the intersection where a normal line of the inner circumferential surface of the fixing belt intersects the second face.

5. The fixing device according to claim 4, wherein the first distance is maximum at an arbitrary position on the nip formation pad in the axial direction of the fixing belt, and wherein the first distance decreases from the arbitrary position to the lateral end accumulation portion in the axial direction of the rotator.

6. The fixing device according to claim 4, wherein the bent portion contacts the inner circumferential surface of the fixing belt, and wherein the first distance increases from the bent portion to an upstream position upstream from the bent portion in the rotation direction of the fixing belt.

7. The fixing device according to claim 4, wherein the bent portion is isolated from the inner circumferential surface of the fixing belt, wherein the first distance is minimum at the bent portion in the rotation direction of the fixing belt, and wherein the first distance increases from the bent portion to an upstream position upstream from the bent portion in the rotation direction of the fixing belt.

8. The fixing device according to claim 1, wherein the bent portion is curved.

9. The fixing device according to claim 8, wherein the bent portion includes:

a contact portion abutting on the first face in the rotation direction of the fixing belt, the contact portion contacting the inner circumferential surface of the fixing belt; and a non-contact portion abutting on the second face in the rotation direction of the fixing belt and being isolated from the inner circumferential surface of the fixing belt.

10. The fixing device according to claim 9, wherein the nip formation pad defines a second distance from an intersection to the inner circumferential surface of the fixing belt, the intersection where a normal line of the inner circumferential surface of the fixing belt intersects the non-contact portion.

11. The fixing device according to claim 10, wherein the second distance is maximum at an arbitrary position on the nip formation pad in the axial direction of the fixing belt, and wherein the second distance decreases from the arbitrary position to the lateral end accumulation portion in the axial direction of the fixing belt.

12. The fixing device according to claim 10, wherein the second distance increases from the contact portion to an upstream position upstream from the contact portion in the rotation direction of the fixing belt.

13. The fixing device according to claim 8, wherein a radius of curvature of the bent portion that is curved decreases from an arbitrary position on the nip formation pad in the rotation direction of the fixing belt, at which the radius of curvature is maximum, to the lateral end accumulation portion in the axial direction of the fixing belt.

14. The fixing device according to claim 1, wherein a bent start position of the bent portion deviates upstream in the rotation direction of the fixing belt from an arbitrary position on the nip formation pad to the lateral end accumulation portion in the axial direction of the fixing belt.

15. The fixing device according to claim 14, wherein the bent portion is curved.

16. An image forming apparatus comprising:

an image bearer to bear a toner image; and a fixing device disposed downstream from the image bearer in a recording medium conveyance direction to fix the toner image on a recording medium, the fixing device including:

a fixing belt rotatable in a rotation direction;

an abutment contacting an outer circumferential surface of the fixing belt;

a nip formation pad, disposed inside the fixing belt, to press in a pressing direction against the abutment via the fixing belt to form a fixing nip between the fixing belt and the abutment, the nip formation pad to bear a lubricant interposed between the nip formation pad and an inner circumferential surface of the fixing belt, the nip formation pad including:

a first face to form the fixing nip, the first face over which the inner circumferential surface of the fixing belt slides;

a second face being disposed upstream from the first face in the rotation direction of the fixing belt and defining a predetermined angle relative to the first face, the second face including an entry bent face that is bent at a bend line at a center in a longitudinal direction of the nip formation pad, at least a portion of the bend line extending out of a plane formed by the pressing direction and the longitudinal direction; and a bent portion coupling the first face to the second face;

a lateral end accumulation portion defined by the second face and the bent portion of the nip formation pad and the inner circumferential surface of the fixing belt and accumulated with the lubricant in a first amount; and a center accumulation portion defined by the second face and the bent portion of the nip formation pad and the inner circumferential surface of the fixing belt and disposed inboard from the lateral end accumulation portion in an axial direction of the fixing belt, the center accumulation portion being accumulated with the lubricant in a second amount greater than the first amount, wherein the lateral end accumulation portion and the center accumulation portion each extend to a start point of the first face that forms the fixing nip.

17. A fixing device comprising:

a fixing belt rotatable in a rotation direction;

an abutment contacting an outer circumferential surface of the fixing belt;

a nip formation pad, disposed inside the fixing belt, to press against the abutment via the fixing belt to form a fixing nip between the fixing belt and the abutment, the nip formation pad to bear a lubricant interposed between the nip formation pad and an inner circumferential surface of the fixing belt, the nip formation pad including:

a first face to form the fixing nip, the first face over which the inner circumferential surface of the fixing belt slides;

a second face being disposed upstream from the first face in the rotation direction of the fixing belt and defining a predetermined angle relative to the first face; and a bent portion coupling the first face to the second face;

a lateral end accumulation portion defined by the second face and the bent portion of the nip formation pad and the inner circumferential surface of the fixing belt and accumulated with the lubricant in a first amount; and a center accumulation portion defined by the second face and the bent portion of the nip formation pad and the inner circumferential surface of the fixing belt and disposed inboard from the lateral end accumulation portion in an axial direction of the fixing belt, the center accumulation portion being accumulated with the lubricant in a second amount greater than the first amount, wherein the bent portion is curved, and wherein a radius of curvature of the bent portion that is curved decreases from an arbitrary position on the nip formation pad in the rotation direction of the fixing belt, at which the radius of curvature is maximum, to the lateral end accumulation portion in the axial direction of the fixing belt.

* * * * *